United States Patent [19]

Bricmont

[11] 4,334,861

[45] Jun. 15, 1982

[54] METHOD AND APPARATUS FOR GENERATING A HOT AIR BLAST

[75] Inventor: Francis H. Bricmont, Pittsburgh, Pa.

[73] Assignee: Bricmont & Associates, Inc., McMurray, Pa.

[21] Appl. No.: 240,281

[22] Filed: Mar. 4, 1981

Related U.S. Application Data

[63] Continuation-in-part of Ser. No. 191,141, Sep. 26, 1980, abandoned.

[51] Int. Cl.[3] ..... F24H 7/00; F28C 3/10

[52] U.S. Cl. ..... 432/30; 432/30;214; 432/216

[58] Field of Search ..... 432/214, 216, 30; 165/9.1, 9.2, 9.3, 9.4

[56] References Cited

U.S. PATENT DOCUMENTS

| | | | |
|---|---|---|---|
| 1,316,086 | 9/1919 | Dovel | 432/30 |
| 1,880,229 | 10/1932 | Andrews et al. | 432/30 |
| 1,978,191 | 10/1934 | Forter | 165/9.2 |
| 3,124,337 | 3/1964 | Fritz | 432/216 |
| 3,150,865 | 9/1964 | Goeke | 432/30 |
| 3,175,816 | 3/1965 | Hyde et al. | 432/216 |
| 3,627,014 | 12/1971 | Akashi et al. | 432/30 |

*Primary Examiner*—John J. Camby

*Attorney, Agent, or Firm*—Thomas H. Murray; Clifford A. Poff

[57] ABSTRACT

A system to supply high temperature blast air and a method for providing preheating of a cold air blast by gas-to-air heating in a tube-type heat exchanger with heat from waste products of combustion. Such combustion products are recovered in a header by the use of valves at different times to form a continuous supply from a plurality of horizontal regenerators. The regenerators are horizontal metal vessels wherein a mid-portion is filled with checkerbrick forming horizontal flow spaces. Each regenerator has a burner to generate hot products of combustion for heating the refractory of the checkerbrick and recovery by the header. The burner is turned OFF when the checkerbricks are highly heated and preheated air is directed by valves through a header and into the regenerator by the checkerbricks. The resulting hot air blast, which may be tempered with cold air, is fed by a main to a blast furnace.

10 Claims, 4 Drawing Figures

METHOD AND APPARATUS FOR GENERATING A HOT AIR BLAST

CROSS-REFERENCE TO RELATED APPLICATION

This application is a continuation-in-part of application Ser. No. 191,141, filed Sept. 26, 1980, now abandoned.

BACKGROUND OF THE INVENTION

This invention relates to a novel interrelationship of recuperators and regenerators to provide a hot air blast with, if desired, a higher temperature but more importantly in a more economical manner to improve the operation of a blast furnace or the like.

The use of a hot air blast in a blast furnace is a necessary and accepted practice for increasing the iron-making capacity while reducing the amount of coke required per ton of iron produced. At the present time, usually three or four blast furnace stoves are used alternately to preheat an air blast before delivery through a hot blast main, bustle pipe and tuyeres into the bottom part of a blast furnace. Heating of the air blast not only intensifies and speeds up the burning of coke at the tuyeres but also reduces the amount of coke required for the smelting operation in the blast furnace. The temperature of the air blast has increased throughout the history of the blast furnace by increasing the capacity, e.g., size of the traditional blast furnace stoves, or increased heating rate, or checker design. However, the efficiency of the antiquated stove design is rapidly becoming unacceptable due to increased costs and decreasing supplies of energy.

The blast furnace stoves used today embody the same basic design as originally developed more than 100 years ago. The size of each stove is approximately 25 feet in diameter and 120 feet high, although more recently-built stoves are each about 30 feet in diameter and 150 feet high. The blast furnace stoves have a brick lining enclosed in a circular steel shell with a flat bottom and a dome-shaped top. In each stove there is a vertical passageway forming a combustion chamber wherein clean blast furnace gas is burned. The combustion chamber extends from a point near the bottom of the stove to the bottom portion of the dome where hot products of combustion pass across a breast wall into a larger vertical regenerator chamber which is substantially filled with superimposed courses of checkerbricks. The filling of checkerbricks which extends from the dome to the bottom part of the stove, extracts heat from the hot products of combustion before being discharged from the bottom of the stove. The checkerwork contains a multiplicity of vertical passageways to conduct the hot products of combustion which move downwardly through the regenerator section. The temperature of the exit gases is a measure of the efficiency of the stove. The heavy weight of modern checkerwork requires metallic supports, typically a metallic grid, in the bottom of the regenerator chamber of the stove to support the checkerwork. The temperature to which the grid can be heated is limited to about 650° F. because of the high loading on the grid and the grid material. A slightly higher temperature limit is possible with properly suited alloy steel. Each layer or course of refractory checkerbrick supports the layer or course above it and, therefore, the height of the stove is a determining factor for the total load that must be sustained by the refractory at the bottom of the regenerator chamber as well as the metallic grid. Because of this stove design, any attempt to increase the temperature of the hot blast requires either a higher dome temperature or a higher checker temperature or both. The refractories now used in the dome and the upper section of the stove are limited to a working temperature of about 2400° F. More expensive and generally less stable refractories must be used to achieve a significant temperature increase.

The combustion chamber location and refractory lining are the source of another major problem in blast furnace stoves. The breast wall of the combustion chamber within the burner area must operate at a temperature at or above 2500° F. on the burner side while at the grid side, the gas exit temperature cannot exceed approximately 650° F. This extreme temperature differential on opposite sides of the same breast wall area causes very high thermal stresses in the refractory with the attending result of high maintenance cost. The high temperature thermal cycling in this area increases maintenance and frequently results in thermally-caused cracks in the wall, permitting short-circuiting of the hot products of combustion.

Irrespective of whether it is desired to increase the temperature of the hot air blast, the efficiency of the blast furnace stoves can be increased by reducing the temperature of waste gases delivered from the stove. In present-day systems of blast furnace stoves, the waste gases of combustion are discharged at a temperature of approximately 650° F. and sometimes even 750° F. An overall increase in the thermal efficiency can be significantly achieved by reducing the temperature of waste gases to, for example, approximately 300° F.

SUMMARY OF THE INVENTION

It is an object of the present invention to provide a system to supply high temperature blast air and a method wherein one, or preferably a plurality of recuperators, receives hot waste products of combustion from regenerators for heating a countercurrent flow of a cold blast of air which is thereafter further heated in a different regenerator having highly heated refractory with horizontal passageways for discharging the hot air into a hot blast main from the end portion of the regenerator having a burner rendered inoperative during such heating of the air blast.

It is a further object of the present invention to provide an improved construction and arrangement of parts capable of providing very high hot blast temperatures, e.g., in excess of 2000° F. with a reliability not possible in present-day stove arrangements, by employing horizontally-arranged vessels each having checkerbricks therein with horizontal passageways to conduct hot products of combustion for heating the refractory and at different times conducting a preheated air blast for further heating thereof to a desired temperature for delivery into a hot blast main.

It is a further object of the present invention to utilize a system to provide high temperature blast air which employs a method wherein products of combustion are burned in a horizontally-arranged regenerator to heat refractory therein and thereafter to form a supply of hot products of combustion which is passed through a recuperator to preheat a counter-current flow of cold blast air.

More particularly, the hot blast system, according to the present invention, includes the combination of a recuperator for heating a cold blast with heat from a separate countercurrent flow of waste products of combustion, means to deliver a cold air blast to the recuperator for providing a substantially continuous preheated air blast, a plurality of horizontal regenerators each having heat storage refractory forming horizontal passageways between opposite end portions for heat exchange with media while flowing in either of opposite directions at different times along the refractory, burner means to feed combustion media into a first end portion of each horizontal regenerator for generating hot products of combustion to heat the refractory therein, first conduit means including a header and flow controllers for providing a substantially continuous supply of hot waste products of combustion to the recuperator from the second end portion of alternate preselected ones of the horizontal regenerators, second conduit means including a header and flow controllers for delivering the preheated air blast from the recuperators to the second end portion of a preselected one of the horizontal regenerators, and third conduit means including a hot blast main coupled to deliver a hot air blast from the first end portion of each of the horizontal regenerators.

The method of the present invention provides for generating a hot air blast by the steps including feeding media for combustion into one end of a first of a plurality of horizontal regenerators to generate hot products of combustion, passing the hot products of combustion along horizontal surfaces of regenerative heat storage refractory within the first horizontal regenerator to heat the refractory to a desired temperature, discharging waste products of combustion into a recuperator from the opposite and second end of the first horizontal regenerator, using the recuperator to preheat an air blast, passing the preheated air blast along highly heated horizontal surfaces of the regenerator heat storage refractory within a second horizontal regenerator to further heat the air blast to a temperature above a minimum desired temperature, terminating the flow of the preheated air blast to the second horizontal regenerator when the minimum desired air blast temperature is no longer attainable, terminating the supply of combustion media to the first horizontal regenerator when the heat storage refractory therein is highly heated, passing the preheated air blast along the highly heated horizontal surfaces of the regenerative heat storage refractory within the first horizontal regenerator for further heating to a temperature above a minimum desired temperature, and conducting the blast of hot air from each of the plurality of regenerators into a hot blast main.

It is preferred to temper the hot air blasts before delivery from the regenerators by admixture with controlled amounts of cold blast air. The heat storage refractories preferably have passageways to permit a lateral as well as a longitudinal flow of combustion products.

These features and advantages of the present invention as well as others will be more fully understood when the following description of the preferred embodiment is read in light of the accompanying drawings, in which.

Figure 1:
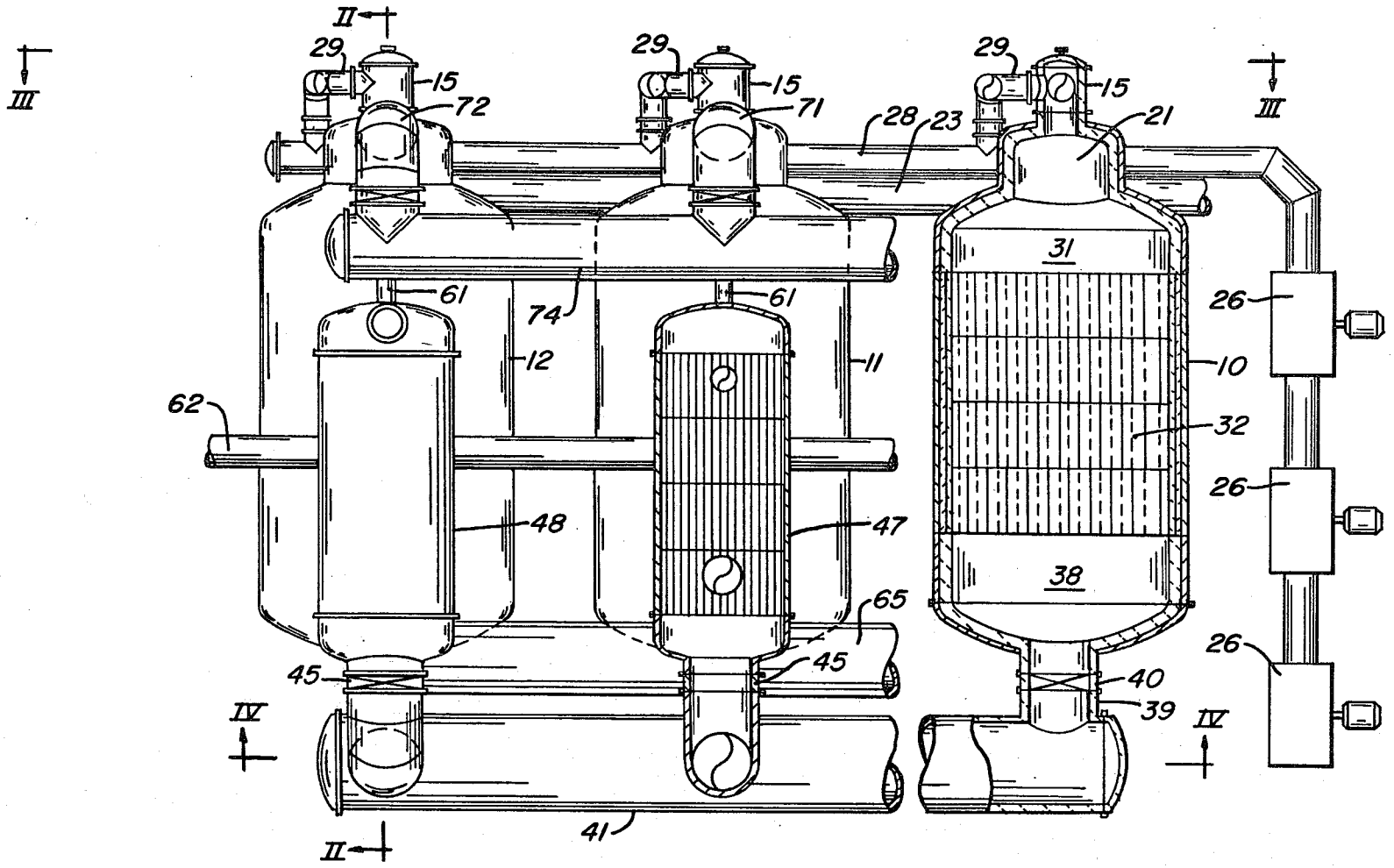
FIG. 1 is a plan view, partly in section, of an apparatus of a system to supply high temperature blast air embodying the features of the present invention and to carry out the method thereof.
Figure 2:
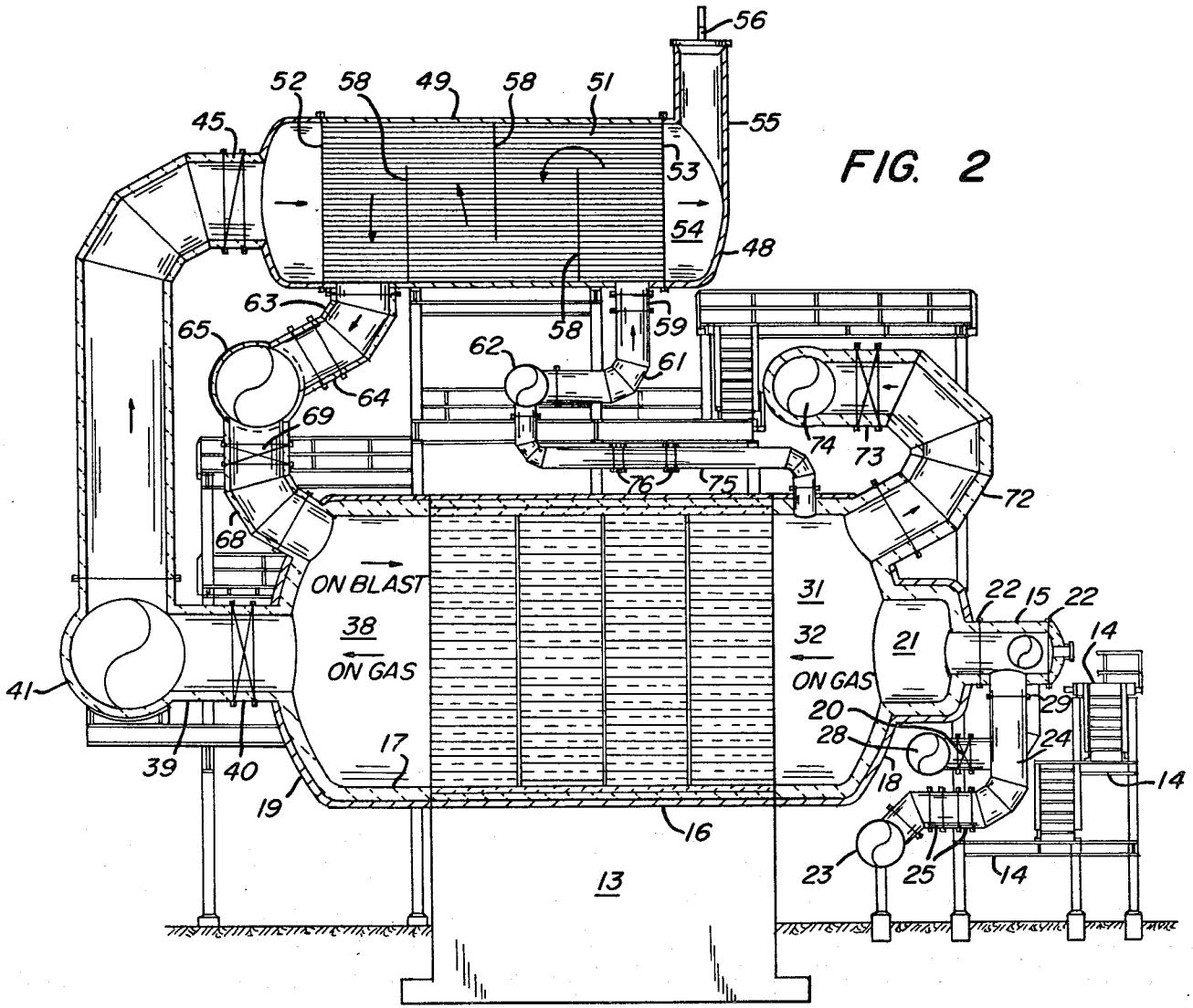
FIG. 2 is a sectional view taken along line II—II of FIG. 1.
Figure 3:
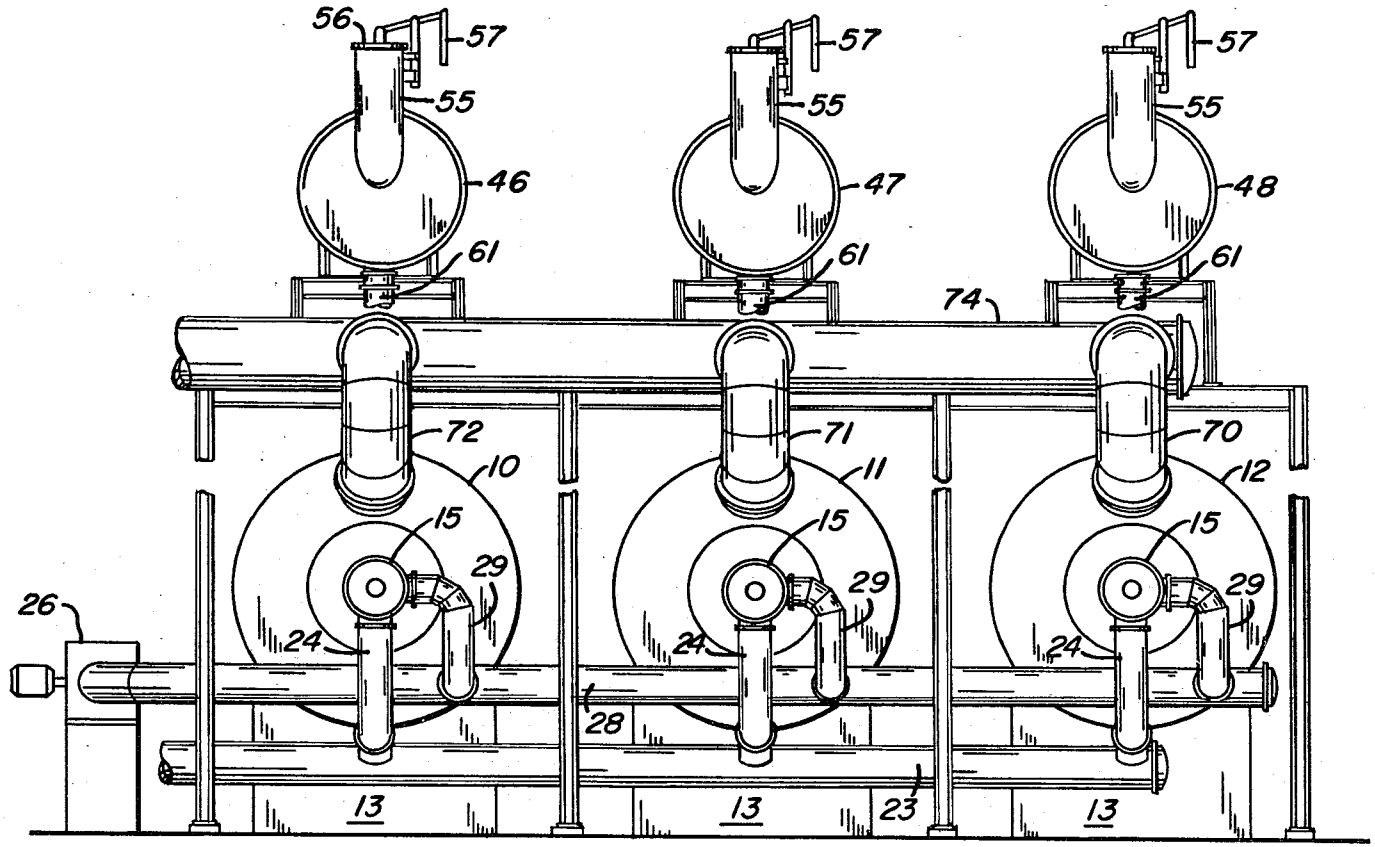
FIG. 3 is a side elevational view taken along line III—III of FIG. 1.
Figure 4:
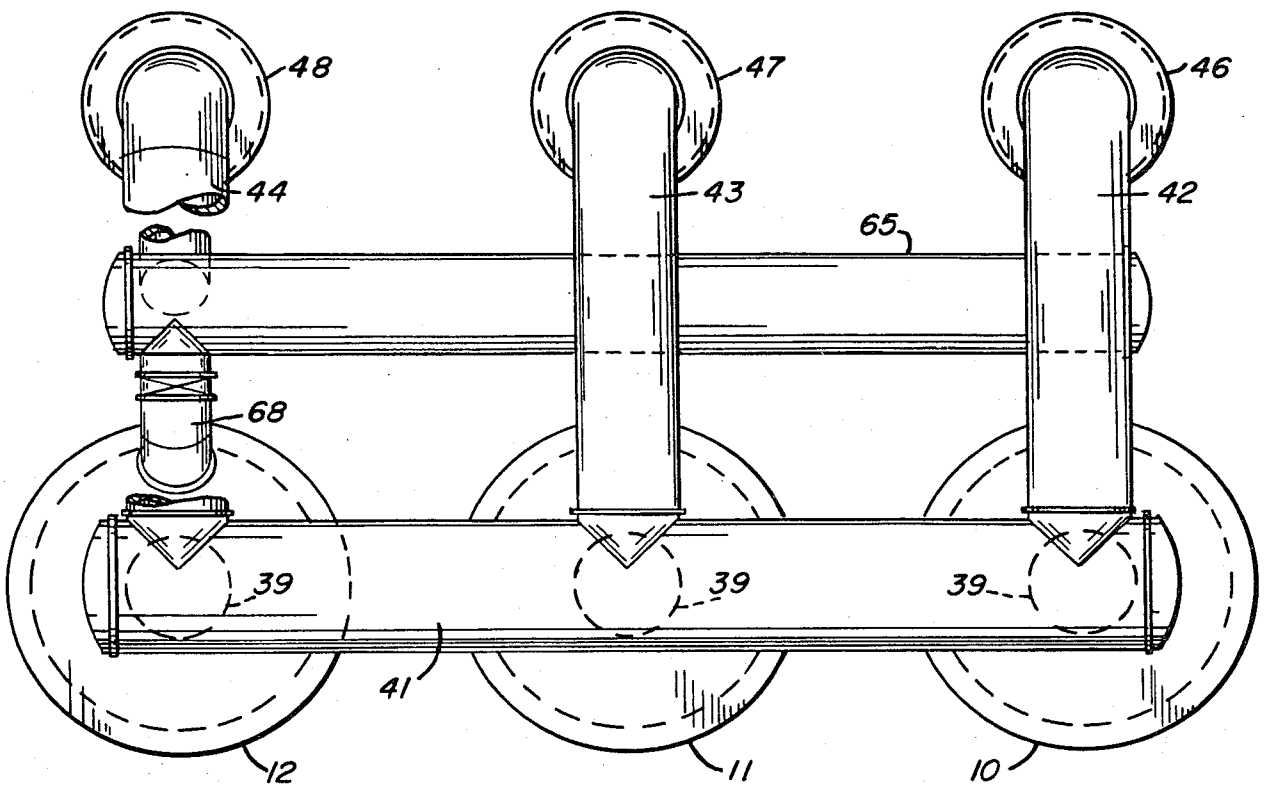
FIG. 4 is a partial side elevational view taken along line IV—IV of FIG. 1.

In FIGS. 1–4, there are illustrated three horizontally-arranged and mutually spaced-apart regenerators 10, 11 and 12 each resting for support on the curved upper surfaces of upstanding foundation pedestals 13. Platforms 14 are accessible by flights of steps to various elevations above the ground level. The platforms extend along the ends of the regenerators which have burner assemblies 15 connected thereto. Each regenerator takes the form of a vessel which includes an outer metal shell 16 and an inner lining of refractory material 17. The ends of each shell are closed by dome-like end walls 18 and 19 also made of metal and supporting an inner lining of refractory material. In FIG. 2, the end wall at the burner end of the regenerator is identified by reference numeral 18 and the dome at the hot gas discharge end is identified by reference numeral 19. At the burner end, the end wall 18 has an enlarged cavity 21 having a wall section to support the burner assembly 15. Coolant rings 22 protect the burner assembly against the high temperature that is generated by the combustion gases in the regenerator. The burner assembly is connected to a gas supply header 23 by a distribution pipe 24 for delivery of a gas such as blast furnace gas to the burner.

Valves 25 in pipe 24 control the flow of gas to the burner. Motor-driven blowers 26 (FIG. 3) grouped at the extreme end of the complex supply air to the air supply header 28. Air valves 20 are utilized in distribution pipes 29 to control the flow of air to burner 15. A chamber 31 is formed in the regenerator between the end wall 18 and a body of heat storage refractory such as checkerbricks 32 having horizontal passageways through and, if desired, between surfaces of the refractory. Typically, the passageways are formed by aligned openings through the checkerbrick. Confronting end walls of the checkerbrick are preferably spaced apart to permit a lateral flow of hot products of combustion as well as a longitudinal flow along the regenerator. At different times, one or more, but not all, of the regenerators is "on gas" when fuel and air are delivered to the burner for combustion in space 31. Heat is generated by the hot products of combustion which are passed, usually near atmospheric pressure, through the passageways in a horizontal direction and a lateral cross flow along the refractory material formed by courses of bricks 32.

The hot products of combustion after passing through the checkerbrick are delivered into a collection chamber 38 and then through a refractory-lined conduit 39 having a water-cooled control valve 40 therein for discharge into a header 41. As shown in FIG. 1, the header 41 is coupled to each of the regenerators 10, 11 and 12 by a conduit 39 for discharge of waste products of combustion therefrom by a selected one or more of vertically-extending feed pipes 42, 43 and 44. Usually all three feed pipes are used to deliver the hot waste products of combustion from two regenerators which are "on gas" while the third regenerator is "on air", i.e., heating an air blast, as will be described in greater detail hereinafter. The feed pipes 42, 43 and 44 deliver the hot products of combustion from any two of the regenerators to any two or more of the recuperators 46, 47 and 48. Water-cooled isolation valves 45 permit isolation of any recuperator desired.

Each recuperator is essentially a gas-to-air heat exchanger and takes the form of a vessel with another metal shell 49 wherein a multitude of heat exchange tubes 51 is supported to extend along between tube plates 52 and 53. As shown in FIG. 2, the hot products of combustion flow within the flow space of the heat exchange tubes 51 in a generally horizontal direction for discharge into a chamber 54 and thence through a flue pipe 55 having a chimney valve 56. Valve 56 is operated by linkage 57 coupled to an actuator, not shown. The flow space between the tube sheets 52 and 53 about the outer surfaces of the tubes 51 is subdivided by baffle plates 58 to cause an incoming blast of cold air to flow countercurrent with the flow of hot gases in the tubes along their reversing paths of travel. The supply of cold air is delivered through a valve 59 from a feed pipe 61 coupled to cold air blast header 62. The system to supply high temperature air is operated to produce a hot air blast at a temperature of at least 2000° F. A cold blast of air delivered by pipe 61 is heated in two or more of the recuperators 46, 47 and 48 to about a temperature of 1000° F. The preheated air is directed by a delivery pipe 63 beyond an isolation valve 64 to an intermediate hot blast header 65. Header 65 is coupled by feed pipes 66, 67 and 68 each having an isolation valve 69 for directing the flow of preheated air into a chamber 38 of one of the regenerators 10, 11 or 12. The regenerator which is selected to receive the preheated blast of air has highly heated refractory surfaces along the horizontal passageway of the refractory bricks 32. It is to be understood that the flow of gas for combustion to the selected regenerator is terminated prior to the introduction of preheated air. The flow of the preheated air from chamber 38 through the flow spaces in the refractory material is carried out at blast pressure used in present-day furnaces. The air blast is heated to a temperature of 2000° F. or greater for delivery from chamber 31 through a hot blast delivery pipe 70, 71 and 72 beyond a flow control valve 73 into a hot blast main 74. During the initial period of time while the preheated air blast flows along the highly heated surfaces of refractory brick 32, the discharge temperature of the gases will typically be substantially above 2000° F. whereby it is usually desirable to temper the hot air blast with a cold air supply introduced to chamber 31 by a delivery pipe 75 having tempering mixer valves 76 therein to control the flow of cold air from a branch pipeline coupled to cold blast header 62. Alternatively, air for tempering the hot air blast may be introduced at burner 15. The cold blast of air supplied by header 62 is typically at approximately 220° F. The system to supply high temperature blast air is preferably designed to permit 100% of the blast airflow which is necessary to provide the hot air blast through about two-thirds of the system whereby part of the system can be taken out of service for maintenance without interrupting the flow of air to the blast furnace. When part of the system is out of service, the temperature of the hot air blast will usually be reduced.

Of particular importance is the fact that the waste gases of combustion are discharged from the recuperator at a temperature of approximately 300° F. which offers a significant improvement over present-day systems where the waste gases of combustion are discharged in the temperature range of between 600° F. and 750° F. The lowering of the temperature of the waste products of combustion increases the overall thermal efficiency of the hot blast system. The use of at least three regenerators permits two regenerators to be heated while one is used to heat the preheated air blast to the desired temperature for use in the blast furnace. A temperature of about 1700° F. at the discharge end 38 of the regenerator when heated during the "on-gas" cycle is readily attainable since the gases flow horizontally along the flow spaces between the checkerbrick or in checkerbricks that are not under severe loading due to superimposed courses of checkerbricks and support limitations imposed by grid structures of present-day blast furnace stoves. The system of the present invention eliminates the need for vulnerable metallic checker supports. Moreover, the regenerators of the present invention can be manufactured in accordance with pressure vessel codes which are presently required in most instances since blast furnace systems operate at a pressure usually within 20 to 50 psi. It is difficult, if not impossible, to construct blast furnace stove vessels of known present-day designs in accordance with the existing code requirements. The present invention permits a reduction to the maximum variation in the temperature of the refractory therein from cycle-to-cycle by the selection of a desired number of heaters in accordance with the desired blast temperature. Thermal cycling of the refractory is significantly reduced as compared with the thermal cycling encountered in existing blast furnace stoves. The average hot blast temperature can be increased by increasing the number of regenerators in the system. It is to be understood, however, that since the present invention is applicable to existing blast furnaces, the hot blast temperatures are subject to limitations of the existing installation. Without limitations of the existing hot blast system downstream from the regenerators, the hot blast temperature can, in most instances, be increased to 2400° F. Given, for example, that the average hot blast temperature by an existing stove system is about 1700° F., then for each 100° F. of temperature increase, the corresponding reduction to coke consumption in the blast furnace is approximately 2.5% or about 25 pounds of coke per ton of iron. Since chamber 21 for each of the various regenerators in the system of the present invention is independent of the regenerative heat storage refractory, the burner and burner chamber can be removed for maintenance without interrupting the regenerator and checker chamber. Moreover, an improved refractory life of the regenerator chamber is achieved by eliminating the high temperature differential that normally exists in known forms of blast furnace stoves between the heat storage regenerator chamber and the combustion chamber.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A system to supply high temperature blast air, said system including the combination of:

at least one recuperator for heating a cold air blast with heat from a separate countercurrent flow of waste products of combustion, means to deliver a cold air blast to said recuperator for providing a substantially continuous preheated air blast, a plurality of horizontal regenerators each having heat storage refractories forming horizontal passageways between opposite end portions for heat exchange with media while flowing in either of opposite directions at different times along the refractories, burner means to feed combustion media into a first end portion of each of said horizontal regenerators for generating hot products of combustion to heat the refractory therein, first conduit means including a header and flow controllers for providing a substantially continuous supply of hot waste products of combustion to said recuperator from second end portions of alternatively preselected ones of said horizontal regenerators, second conduit means including a heater and flow controllers for delivering the preheated air blast from said recuperators to the second end portion of a preselected one of said horizontal regenerators, and third conduit means including a hot blast main coupled for delivering a hot air blast from the first end portion of each of said horizontal regenerators.

2. The blast furnace stove system according to claim 1 further including means to deliver a flow of air for tempering the hot air blast conducted by said third conduit means.

3. The blast furnace stove system according to claim 1 wherein the heat storage refractories in said plurality of regenerators include checkerbrick defining longitudinal and lateral flow spaces between opposite end portions of each regenerator.

4. The blast furnace stove according to claim 1 wherein said recuperator includes a vessel and a multiplicity of tubes in said vessel for gas-to-air heat exchange.

5. The blast furnace stove according to claim 1 wherein said at least one recuperator includes spaced-apart tube plates, a multiplicity of heat exchange tubes supported by said tube plates to conduct products of combustion between opposite ends of the recuperator, and baffle plates to deflect blast air to be heated about the outer surfaces of said heat exchange tubes.

6. A method of generating a hot air blast including the steps of:

feeding media for combustion into one end of a first of a plurality of horizontal regenerators to generate hot products of combustion, passing said hot products of combustion along horizontal surfaces of regenerative heat storage refractory within the first horizontal regenerator to heat the refractory to a desired temperature, discharging waste products of combustion into a recuperator from the opposite and second end of the first horizontal regenerator, using said recuperator to preheat an air blast, passing the preheated air blast along highly heated horizontal surfaces of regenerative heat storage refractory within a second horizontal regenerator to further heat the air blast to a temperature above a minimum desired temperature.

terminating the flow of the preheated air blast to the second horizontal regenerator when the minimum desired air blast temperature is no longer attainable, terminating the supply of combustion media to said first horizontal regenerator when the heat storage refractory therein is highly heated, passing the preheated air blast along the highly heated horizontal surfaces of regenerative heat storage refractory with said first horizontal regenerator for further heating to a temperature above a minimum desired temperature, and conducting the blasts of hot air from each of the plurality of regenerators in a hot blast main.

7. The method according to claim 6 including the further step of tempering the blasts of hot air from each of the regenerators with a cold air supply.

8. The method according to claim 7 wherein said step of tempering includes admixing a controlled supply of cold air with a blast of air after heating in a horizontal regenerator.

9. The method according to claim 6 wherein said step of discharging waste products of combustion includes directing such waste products into the recuperators.

10. The method according to claim 9 wherein said step of using said recuperator includes passing waste products of combustion countercurrent to a cold air supply for gas-to-air heat exchange.

* * * * *